United States Patent [19]

Miller

[11] 4,275,747

[45] Jun. 30, 1981

[54] SMOKING PIPE

[76] Inventor: William L. Miller, 70 West Dr., Congress Lake, Hartville, Ohio 44632

[21] Appl. No.: 70,974

[22] Filed: Aug. 30, 1979

[51] Int. Cl.[3] ..... A24F 5/04

[52] U.S. Cl. ..... 131/195; 131/198 A

[58] Field of Search ..... 131/195, 198 R, 198 A, 131/199

[56] References Cited

U.S. PATENT DOCUMENTS

| | | | |
|---|---|---|---|
| 1,212,590 | 1/1917 | Waigand | 131/198 A |
| 1,664,146 | 3/1928 | Wilson | 131/198 R |
| 1,989,069 | 1/1935 | Warnke | 131/198 R |
| 2,216,303 | 10/1940 | Taylor | 131/195 |

FOREIGN PATENT DOCUMENTS

| | | | |
|---|---|---|---|
| 8626 | of 1899 | United Kingdom | 131/198 R |

*Primary Examiner*—Stephen C. Pellegrino

*Attorney, Agent, or Firm*—Watts, Hoffmann, Fisher & Heinke Co.

[57] ABSTRACT

A smoking pipe having a metal air injection pin in the stem for conductively cooling the smoke and for introducing and mixing a controlled amount of air into the smoke stream proportional to the smoke stream velocity.

4 Claims, 4 Drawing Figures

SMOKING PIPE

CROSS REFERENCE TO RELATED APPLICATION

A design patent application Ser. No. 70975, Aug. 30, 1979, filed by William L. Miller concurrently herewith and entitled SMOKING PIPE, is related to this invention.

BACKGROUND

1. Field of the Invention

This invention relates to smoking pipes and particularly to a pipe with an improved construction for cooling the smoke and introducing air through the stem into the smoke stream.

2. Prior Art

Many smoking pipes provide metal members within the pipe stem to condense moisture and tar. However, these condensers soon reach a high temperature and lose effectiveness. In some pipes a condenser is partially exposed to the outside of the pipe and to the surrounding cooler air to reduce this problem. Also, air is sometimes introduced to the smoke through an opening in the pipe when the smoker draws on the pipe, to provide a cooler smoke. Examples of prior pipes of the above type are shown in U.S. Pat. Nos. 119,075; 890,751; 1,656,922; 2,216,303; 2,343,003; and 3,286,715. Such pipes typically fail to provide both an effective condenser and a means for introducing air to the smoke, and/or they require very unusual structures that adversely affect the weight and appearance of the pipe, and where air is drawn into the flow of smoke they rely only and directly upon the drawing action of the smoker to suck air into the flow.

SUMMARY OF THE INVENTION

In accordance with the present invention, a smoking pipe is provided with a small metal air injection pin in the stem of the pipe. The pin has a central passageway, an inner condenser portion that extends into the smoke-conducting passage of the stem and also serves as a port for introducing air into the smoke stream, and an outer heat-radiating portion that also serves as a port for allowing air to enter the pipe stem between the pipe bowl and mouthpiece opening. The pin passageway is perpendicular to the stem passage and the pin terminates about half-way across the passage. As a result, the inner portion not only contacts the smoke, but also the velocity of the smoke, moving directly across the open inner end of the passageway, aspirates outside air into the flow of smoke in proportion to the velocity of the smoke, where it is mixed in the stem as the smoke and air flow to the mouthpiece opening.

To promote the conduction of heat from within the stem to the outside and thereby retain the effectiveness of the pin as a condenser, the portion of the pin embedded in the stem at the outside of the pipe is constructed to conduct heat at a greater rate than the portion that extends into the smoke-conducting passage of the stem. In the preferred embodiment this is achieved by providing the embedded portion with a greater cross sectional area and a large radiating surface.

Preferably the pin is located in a portion of the stem that has an enlarged internal condensation chamber between two smaller cross sectional passage portions, one adjacent the bowl and the other adjacent the mouthpiece outlet. By locating the pin close to the passage portion from the bowl, where the smoke velocity in the chamber is greatest, it will aspirate air most effectively, which will then mix well with the smoke in the enlarged chamber. Ideally, the chamber is constructed with a lower portion that serves as a trap to collect condensation from the pin.

The above and other features and advantages of this invention will become better understood from the detailed description that follows, when considered in connection with the accompanying drawings.

DETAILED DESCRIPTION OF A PREFERRED EMBODIMENT

Figure 1:
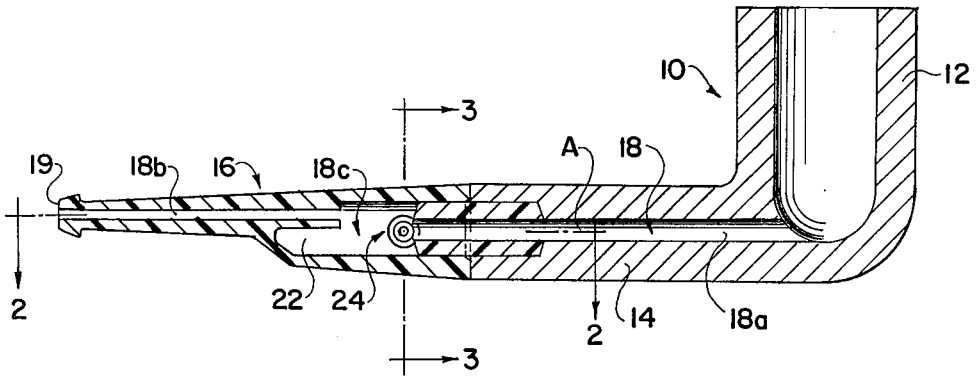
FIG. 1 is a longitudinal sectional view of a smoking pipe embodying the present invention.

With reference to the drawings, a smoking pipe 10 is shown embodying the present invention. The pipe 10 has a bowl 12 with an integral shank 14 and a stem or bit 16 that serves as a mouthpiece and is frictionally secured to the shank in a standard manner. The shank 14 and stem 16 together form a smoke-conducting passage 18 between the bowl 12 and an open end 19 of the stem. The smoke-conducting passage 18 has a small diameter portion **18*a* along the bowl shank 14 and another small diameter portion 18*b* in the stem 16 adjacent the end 19. An enlarged condensation chamber 18*c* is in the stem between the two small diameter portions 18*a*, 18*b* and has a lower extension 22** that serves as a pocket or trap for condensate.

Figure 2:
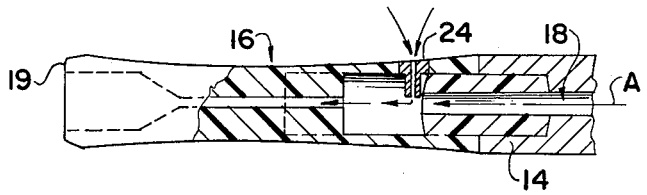
FIG. 2 is a partial longitudinal sectional view taken along the line 2—2 and looking in the direction of the arrows.
Figure 3:
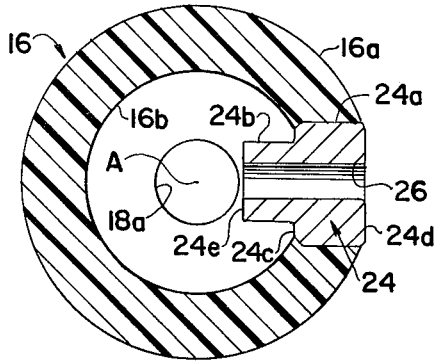
FIG. 3 is a transverse sectional view of the smoking pipe of FIG. 1 taken along the line 3—3 and looking in the direction of the arrows.

A metal air injection pin 24 is secured in the stem 16 by friction or with an adhesive, and extends from an external surface **16*a* (FIG. 3) of the stem inwardly, beyond an internal surface 16*b* into the condensation chamber portion 18*c* of the smoke-conducting passage 18. In the preferred embodiment, the pin is made of brass, but alternatively can be of other heat-conductive metal. A central passageway or bore 26 extends through the pin perpendicular to the longitudinal extent of the passage 18 and is of relatively small diameter, approximately 0.05 inch (made with a No. 55 drill) in the preferred embodiment. As best illustrated in FIG. 3, the pin 24 has two body portions that are cylindrical in the preferred embodiment. An outer body portion 24*a* is embedded in the wall of the stem 16. An inner body portion 24*b* is of smaller diameter than the outer portion and extends inwardly from the inside stem wall 16*b* into the smoke conducting passage 18. An annular shoulder 24*c* is between the two portions 24*a* and 24*b*, essentially flush with the inside wall 16*b*. The outer body portion 24*a* is enough larger, i.e., greater in cross section, than the inner body portion 24*b* to promote effective heat flow from the inner body portion to the outer body portion. An outer surface 24*b* of the outer body portion 24*a* serves as a radiator, which in combination with the larger cross sectional area of the outer body portion, keeps the inner portion at as low a temperature as practical. In a preferred embodiment, in which a tapered pipe stem has an outside diameter of 0.612 inch at its largest portion and an inside diameter of the condensation chamber of 0.375 inch, the pin 24 located as shown in the drawings has an axial length in the direction of the passageway of 0.22 inch. The length of the outer body portion 24***a* is 0.120 inch, the diameter of the outer body portion is 0.1875 inch and the diameter of the inner body portion 24*b* is 0.125 inch. The end 24*e* of the inner body portion is located close to but short of the central axis A of the smoke-conducting passage 18. See FIGS. 2 and 3.

In the preferred construction, the pin 24 is located adjacent the small diameter portion 18*a* of the passage 18, where the velocity of the smoke drawn through the pipe is greater than at subsequent locations along the condensation chamber 18*c*, where the cross sectional area of the chamber is greater than the passage portion through the shank.

With the small diameter central passageway 26 of the pin 24 oriented perpendicular to the direction of flow of smoke through the smoke-conducting passage 18, smoke drawn through the pipe stem, past the inner end of the pin and central passageway 26, aspirates air into the chamber 18*c*, because of the decreased static pressure in part caused by the velocity of the flow across the inner opening of the central passageway 26. Thus, inflow of air through the passageway 26 is not merely due to decreased internal pressure by the drawing action at the end opening 19, but is also due to the flow of smoke past the opening of the central passageway. The amount of air drawn into the smoke-conducting passage through the central passageway of the pin is in this manner proportional to the smoke flow, so that by proper sizing of the central passageway 26, appropriate relative volumes of air and smoke are obtained and a desired mixture is achieved. The diameter of the passageway 26 is relatively small compared to the diameter of the upstream passage portion 18*a* from the pipe bowl, so there is greater resistance to flow through the passage than from the bowl, assuring that a significantly greater quantity of smoke than air is drawn through the stem. For example, in a preferred embodiment the stem passage 18*a* has a diameter of between 3 and 5 mm., preferably 4 mm. or 0.157 inch; and the diameter of the passageway 26 has a diameter of between 0.040 and 0.060 inch, preferably between 0.045 and 0.055 inch, and in the preferred embodiment is 0.052 inch.

Both the inner end surface 24*e* of the pin and the cylindrical surface of portion 24*b*, plus the shoulder 24*c* between the inner and outer portions are exposed to the hot smoke within the condensation chamber 18*c*. As a result, these surfaces transfer heat to the larger diameter outer body portion 24*a* which has a greater capacity for heat transmission than the inner body portion, to conduct heat from the inner portion so the inner portion stays cooler than the smoke and functions effectively as condenser. Condensed tar and moisture from the inner body portion falls from the pin and collects in the trap 22.

From the foregoing description it will be appreciated that the construction and arrangement of the smoking pipe 10, and specifically the construction and arrangement of the metal air injection pin 24 and its location and arrangement in the stem 16, achieves the desirable effect of cooling the smoke, condensing moisture and tar, and introducing a controlled flow of air into the flow of smoke from the pipe bowl to the stem outlet. As a result, cool, dry and mild smoking characteristics are achieved.

Figure 4:
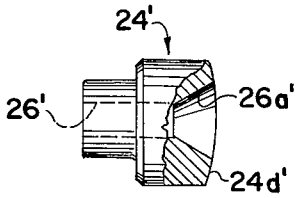
FIG. 4 is an elevational view, partly in section, of a modified pin.

A modified injection pin 24' is shown in FIG. 4, identical to the pin 24 except that a central passageway 26' has a flared entry portion 26*a'* to slightly decrease the flow resistance of the passageway, and has an outer end surface 24*d'* having a curvature of the same radius as the outside surface 16*a* of the stem 16.

While a preferred embodiment of the invention has been described in detail, it will be apparent that various modifications or alterations may be made therein without departing from the spirit and scope of the invention set forth in the appended claims. For example, one modification contemplated is the use of a pin in which the outer body portion is of a cross sectional size comparable to the inner body portion, but of a metallic material having a substantially higher coefficient of conductivity, so that it will dissipate the heat from the inner body portion at a faster rate without being of greater dimensions. Also, if desired, the outer surface of the outer body can terminate in an enlarged flange that will provide a greater radiating surface for the heat conducted from within the condensation chamber.

What is claimed is:

1. A smoking pipe comprising a pipe bowl and an elongated stem extending from the bowl, said stem having an outlet opening and a longitudinal smoke-conducting passage communicating between the bowl and the outlet opening, and a metal air injection pin in the stem, said pin having an outer portion embedded in the stem, an outer surface essentially flush with the outer surface of the stem, an inner portion extending into the smoke-conducting passage beyond an inner wall of the stem forming the smoke-conducting passage and terminating within the passage adjacent the longitudinal center thereof, and a central air passageway in the pin extending perpendicular to the longitudinal extent of the stem, the central passageway having a diameter small relative to that of the longitudinal smoke-conducting passage and the embedded outer portion of the pin having a significantly larger cross sectional area than the extending inner portion to conduct heat at a greater rate than the inner portion.

2. A smoking pipe as set forth in claim 1 wherein the smoke-conducting passage includes an enlarged condensation chamber between smaller cross sectional portions of the passage that are adjacent the bowl and the outlet opening, and the pin is located in the portion of the stem forming the enlarged condensation chamber.

3. A smoking pipe as set forth in claim 1 wherein an annular shoulder exists where the inner portion jons the outer portion, and the shoulder is exposed to the smoke-conduting passage.

4. A smoking pipe as set forth in claim 1 wherein said air-conducting passageway has a diameter of between 0.040 and 0.060 inch.

* * * * *